US010825428B2

(12) United States Patent
Clissold

(10) Patent No.: US 10,825,428 B2
(45) Date of Patent: Nov. 3, 2020

(54) MUSICAL INSTRUMENT AND METHOD OF MAKING SAME

(71) Applicant: NUVO INSTRUMENTAL (ASIA) LIMITED, Hong Kong (HK)

(72) Inventor: Maximilian Spencer Clissold, Hong Kong (HK)

(73) Assignee: NUVO INSTRUMENTAL (ASIA) LIMITED, Hong Kong (HK)

( * ) Notice: Subject to any disclaimer, the term of this patent is extended or adjusted under 35 U.S.C. 154(b) by 0 days.

(21) Appl. No.: 16/810,595

(22) Filed: Mar. 5, 2020

(65) Prior Publication Data

US 2020/0202821 A1 Jun. 25, 2020

Related U.S. Application Data

(63) Continuation of application No. 16/224,440, filed on Dec. 18, 2018, now Pat. No. 10,593,308.

(Continued)

(51) Int. Cl.

| | |
|---|---|
| ***G10D 9/04*** | (2020.01) |
| ***G10D 7/10*** | (2006.01) |
| ***G10D 9/08*** | (2020.01) |

(52) U.S. Cl.

CPC ..... *G10D 9/04* (2013.01); *G10D 7/10* (2013.01); *G10D 9/08* (2020.02)

(58) Field of Classification Search

CPC ..... G10D 9/04; G10D 9/08; G10D 7/10

See application file for complete search history.

(56) References Cited

U.S. PATENT DOCUMENTS 5,919 A 11/1848 Wiles et al.
74,331 A 2/1868 Fiske (Continued)

FOREIGN PATENT DOCUMENTS

EP 2422340 A2 2/2012

OTHER PUBLICATIONS

European Search Opinion for EP 18 213 674.7 dated May 6, 2019, 12 pages.

(Continued)

*Primary Examiner* — Robert W Horn
(74) *Attorney, Agent, or Firm* — Cozen O'Connor

(57) ABSTRACT

A valved wind instrument including a tubular body having a tuning section, a lead pipe connected to a first end of the tuning section and a bell pipe connected to a second end of the tuning section, said tubular body being configured to allow a vibrating column of air to pass therethrough; wherein the tuning section includes an air inlet port for receiving air flow from the lead pipe at the first end, an air outlet port for delivering said air flow to the bell tube at the second end, a plurality of user operable valves; wherein each valve of said plurality of valves is in fluid communication with an adjacent valve by a first tubular portion so as to provide fluid communication between the inlet port and the outlet port, and wherein each valve of said plurality of valves is user moveable between a first position and a second position and each so as to increase the air pathway length between the inlet port and the outlet port by way of a second tubular portion; and wherein each second tubular portions is coplanar with each other, and wherein the second tubular portions are integrally formed from a polymeric material within the tuning section, wherein the tuning section is provided by molded first and second body member that are (Continued)

bonded together and sealingly engaged along a plane parallel to the longitudinal axes of the second tubular portions.

16 Claims, 8 Drawing Sheets

Related U.S. Application Data

(60) Provisional application No. 62/607,679, filed on Dec. 19, 2017.

(56) References Cited

U.S. PATENT DOCUMENTS

| | | | | | |
|---|---|---|---|---|---|
| 284,492 | A * | 9/1883 | Schweich | G10D 7/10 | 84/393 |
| 434,270 | A * | 8/1890 | Heald | G10D 7/10 | 84/394 |
| 1,428,675 | A * | 9/1922 | Alschausky | G10D 7/10 | 84/395 |
| 1,703,411 | A * | 2/1929 | Steinmetz | G10D 9/04 | 84/390 |
| 1,823,838 | A | 9/1931 | Milette | | |
| 1,924,399 | A * | 8/1933 | Fiorino | G10D 7/10 | 84/388 |
| 2,373,110 | A * | 4/1945 | Forssberg | G10D 7/10 | 84/387 R |
| 2,484,408 | A * | 10/1949 | Hubley | G10D 7/10 | 84/390 |
| 3,308,707 | A * | 3/1967 | Kelischek | G10D 7/063 | 84/380 C |
| 3,375,746 | A | 4/1968 | Proll | | |
| 4,112,806 | A * | 9/1978 | Thayer | G10D 9/04 | 84/390 |
| 4,213,371 | A * | 7/1980 | Thayer | G10D 9/04 | 84/390 |
| 4,469,002 | A | 9/1984 | Thayer | | |
| 4,905,564 | A * | 3/1990 | Thayer | G10D 9/04 | 84/390 |
| 5,686,678 | A * | 11/1997 | Greenhoe | G10D 9/04 | 84/390 |
| 6,207,884 | B1 | 3/2001 | Hsieh | | |
| 6,255,571 | B1 | 7/2001 | Takahashi | | |
| 7,608,768 | B2 | 10/2009 | Thanyakij | | |
| 7,910,815 | B2 * | 3/2011 | Olsen | G10D 9/04 | 84/388 |
| 8,138,405 | B2 * | 3/2012 | Hsiao | F16K 5/16 | 84/396 |
| 8,466,362 | B2 * | 6/2013 | Hsiao | G10D 9/04 | 84/390 |
| 9,153,216 | B2 * | 10/2015 | Tetreault | G10D 9/04 | |
| 9,761,206 | B2 | 9/2017 | Ban | | |
| 10,593,308 | B2 * | 3/2020 | Clissold | G10D 7/10 | |
| 2005/0076769 | A1 * | 4/2005 | Singer | G10D 7/10 | 84/387 R |
| 2010/0275759 | A1 | 11/2010 | Hsiao | | |
| 2019/0189092 | A1 * | 6/2019 | Clissold | G10D 7/10 | |
| 2019/0287498 | A1 | 9/2019 | Poulin | | |
| 2020/0202821 | A1 * | 6/2020 | Clissold | G10D 9/04 | |

OTHER PUBLICATIONS

European Search Report for EP 18 21 3674 dated May 6, 2019, 5 pages.

Partial European Search Report for EP 18 21 3674 dated May 6, 2019, 4 pages.

Provisional Opinion Accompanying the Partial Search Result for EP 18 213 674.7 dated May 6, 2019, 12 pages.

* cited by examiner

MUSICAL INSTRUMENT AND METHOD OF MAKING SAME

TECHNICAL FIELD

The present invention relates to the field of valved wind instruments and methods of making same.

BACKGROUND OF THE INVENTION

Brass type musical wind instruments typically utilise several metal tubing lengths in order to provide tone intervals in conjunction with harmonics, whereby flow of air from the mouthpiece end to the bell pipe end of the instrument is routed by a player via different air passage ways due to combinations of different tubing, such that an appropriate pitch or tone range is provided.

In order to route passage of air through the instrument, a player-operable valve arrangement is provided, whereby movement of one or more valves routes air flow through some air passage ways whilst occluding others, so as to provide the requisite air passage way length for a desired musical note. Such valves are comprised of a moveable valve member which is movable relative to a valve housing in which it is contained.

Traditionally brass instruments use linear valves as a valve piston which move in a linear direction within a cylindrical sleeve or valve housing responsive to a linear force from a player's finger movement. The valve piston is then returned to an initial state by way of a return spring. Such linear valves are typically utilised in trumpets, tenor horns, tubas, euphoniums and the like.

In some other brass instruments, rotary valves may be used such as are utilised in a French horn, and are operable by key members, to move the valve body in a rotary direction within a circular sleeve or valve housing, similarly as to vary the length of the air passage way within the tubular body of the instrument during play and thereby change the pitch of the instrument.

Such linear and rotary valves tend to require a relatively high degree of precision to manufacture including machining of the curved metal surface of the valve piston or valve rotor (valve element) to ensure that openings of air passage ways located in and extending through the curved surface of the cylindrical valve body are able to align precisely with corresponding openings in the housing when the valve is rotated so as to appropriately re-direct air flow through different air-flow passage ways within the tubular body. Precision machining of such linear and rotary valves is also required to prevent air escaping from between the contact formed by the curved inner surface of the valve housing and the curved outer surface of the valve element, which causes significant loss in sound energy and quality A common frustration to instrument players is sticky or lagging valves, which due to alignment, wear, precision of fit, insufficient lubricant, can cause incomplete, delayed or gradual occlusion and opening of air passage ways, causing interruption of playing of an instrument by a player. Often, heavy return springs are used to return the moveable valve element to its initial position, and such biasing force is required to be overcome in order to move the valve, which can particularly be difficult for young players to operate.

Poor intonation provided by some brass instruments (that is, the pitch between notes) is another frustration to players, and often exists in lower-end cost instruments. Reasons for poor intonation can include inaccurate tube lengths for various portions of a brass instrument such a both fixed length and optionally slidable members, as well as connecting tubes between valves, and small changes in length or inaccuracy in manufacture can affect the intonation of a brass instrument.

SUMMARY OF THE INVENTION

The present invention seeks to alleviate at least one of the above-described problems.

The present invention may involve several broad forms. Embodiments of the present invention may include one or any combination of the different broad forms herein described.

In one broad form, the present invention provides a valved wind instrument including: a tubular body having a tuning section, a lead pipe connected to a first end of the tuning section and a bell pipe connected to a second end of the tuning section, said tubular body being configured to allow a vibrating column of air to pass therethrough; a valve operable by a key assembly for movement relative to the tuning section between at least one of a first configuration and a second configuration to selectably vary a length of the tubular body through which the vibrating column of air passes when arranged in the first and second configurations and thereby selectably vary an output pitch of the valved wind instrument; wherein the valve and the tuning section each include a respective planar surface that are configured to lie flat against each other or flat against an intermediary planar layer as the valve is moved relative to the tuning section between the first configuration and the second configuration and whereby air ingress and air egress openings are disposed in the planar surfaces of the valve and the tuning section, said air ingress and air egress openings in the respective planar surfaces being configured for movement in to alignment with each other in varying configurations as the valve is moved relative to the tuning section between the first configuration and the second configuration so as to selectably vary the length of the tubular body through which the vibrating column of air passes when arranged in the first and second configurations.

Preferably, the tubular body may be formed from a polymeric material.

Preferably, the tubular body may include separately molded first and second tubular body members that are bonded together.

Preferably, the first and second tubular body members may be bonded together by ultrasonic welding.

Preferably, the planar surfaces of the valve and the tuning section may be configured for at least one of rotational and slidable movement relative to each other as the valve is moved relative to the tuning section between the first configuration and the second configuration so as to selectably vary the length of the tubular body through which the vibrating column of air passes Preferably, the present invention may include at least one intermediate planar layer disposed between the planar surfaces of the valve and of the tuning section, said at least one intermediate planar layer including at least one of a polymeric material and a ceramic material.

Preferably, the present invention may include a sealing gasket layer disposed between the planar surfaces of the valve and of the tuning section.

Preferably, at least three intermediate planar layers may be disposed between the planar surfaces of the valve and of the tuning section, said three intermediate planar layers including a first and second intermediate planar layers formed from a Polytetrafluoroethylene (PTFE) material disposed adjacent the planar surfaces of the valve and tuning section, and a third intermediate planar layer disposed between the first and second intermediate planar layers, said third intermediate planar layer may include the sealing gasket layer being formed from an elastomeric material.

Preferably, the key assembly may include: a finger-operable key member that is movable between at least one of a first position and a second position, said key member being biased into the first position by a biasing member; a connecting member operably-coupled at a first end to the key member and at a second end to the valve such that responsive to movement of the key member from the first position in to the second position, the connecting member is configured to move the valve relative to the tuning section between the first and second configurations respectively.

Preferably, the key assembly may include a polymeric material.

Preferably, the key member of the key assembly may include at least one of a depressible button and a lever.

In another broad form, the present invention provides a valve for used with a valved wind instrument, said valved wind instrument including: a tubular body configured having a tuning section, a lead pipe connected to a first end of the tuning section and a bell pipe connected to a second end of the tuning section, said tubular body being configured to allow a vibrating column of air to pass therethrough; said valve being operable for movement relative to the tuning section between at least one of a first configuration and a second configuration to selectably vary a length of the tubular body through which the vibrating column of air passes when arranged in the first and second configurations and thereby selectably vary an output pitch of the valved wind instrument; wherein the valve and the tuning section each include a respective planar surface that are configured to lie flat against each other or flat against an intermediary planar layer as the valve is moved relative to the tuning section between the first configuration and the second configuration and whereby air ingress and air egress openings are disposed in the planar surfaces of the valve and the tuning section, said air ingress and air egress openings in the respective planar surfaces being configured for movement in to alignment with each other in varying configurations as the valve is moved relative to the tuning section between the first configuration and the second configuration so as to selectably vary the length of the tubular body through which the vibrating column of air passes when arranged in the first and second configurations.

Preferably, the tubular body of the valved wind instrument may be formed from a polymeric material.

Preferably, the tubular body of the valved wind instrument may include separately molded first and second tubular body members that are bonded together.

Preferably, the first and second tubular body members of the valved wind instrument may be bonded together by ultrasonic welding.

Preferably, the planar surfaces of the valve and the tuning section of the valved wind instrument may be configured for at least one of rotational and slidable movement relative to each other as the valve is moved relative to the tuning section between the first configuration and the second configuration so as to selectably vary the length of the tubular body through which the vibrating column of air passes Preferably, the present invention may include at least one intermediate planar layer disposed between the planar surfaces of the valve and of the tuning section of the valved wind instrument, said at least one intermediate planar layer including at least one of a polymeric material and a ceramic material.

Preferably, the present invention may include a sealing gasket layer disposed between the planar surfaces of the valve and of the tuning section.

Preferably, at least three intermediate planar layers may be disposed between the planar surfaces of the valve and of the tuning section of the valved wind instrument, said three intermediate planar layers including a first and second intermediate planar layers formed from a PTFE material disposed adjacent the planar surfaces of the valve and tuning section of the valved wind instrument, and a third intermediate planar layer disposed between the first and second intermediate planar layers, said third intermediate planar layer including the sealing gasket layer formed from a elastomeric material.

Preferably, the key assembly may include: a finger-operable key member that is movable between at least one of a first position and a second position, said key member being biased into the first position by a biasing member; and a connecting member operably-coupled at a first end to the key member and at a second end to the valve such that responsive to movement of the key member from the first position in to the second position, the connecting member is configured to move the valve relative to the tuning section between the first and second configurations respectively.

Preferably, the key assembly is formed from a polymeric material.

Preferably, the key member of the key assembly may include at least one of a depressible button and a lever.

In a further broad form, the present invention provides a valved wind instrument including a tubular body having a tuning section, a lead pipe connected to a first end of the tuning section and a bell pipe connected to a second end of the tuning section, said tubular body being configured to allow a vibrating column of air to pass therethrough; wherein the tuning section includes an air inlet port for receiving air flow from the lead pipe at the first end, an air outlet port for delivering said air flow to the bell tube at the second end, a plurality of user operable valves; wherein each valve of said plurality of valves is in fluid communication with an adjacent valve by a first tubular portion so as to provide fluid communication between the inlet port and the outlet port, and wherein each valve of said plurality of valves is user moveable between a first position and a second position and each so as to increase the air passage way length between the inlet port and the outlet port by way of a second tubular portion; and wherein each second tubular portions is coplanar with each other, and wherein the second tubular portions are integrally formed from a polymeric material within the tuning section, wherein the tuning section is provided by molded first and second body member that are bonded together and sealingly engaged along a plane parallel to the longitudinal axes of the second tubular portions.

Preferably, the first and second body members are bonded together by ultrasonic welding.

Preferably, the first tubular portions are coplanar with the second tubular portions, and wherein the first tubular portions are integrally formed with the second tubular portions.

It would be appreciated that embodiments of the present invention may assist in providing at least one of the following advantages:

BRIEF DESCRIPTION OF THE DRAWINGS

The present invention will become more fully understood from the following detailed description of a preferred but non-limiting embodiments thereof, described in connection with the accompanying drawings, wherein.

DETAILED DESCRIPTION OF THE PREFERRED EMBODIMENTS

Preferred embodiments of the present invention will now be explained with reference to the FIGS. 1 to 8. The present invention is applicable to valved wind musical instruments which are typically called a "brass instrument" which includes a lead pipe, a tuning section and a bell pipe, whereby sound is generated by the lips of a player vibrating from air expired therebetween into a mouthpiece. Such instruments are also called also called labrosones, literally meaning "lip-vibrated instruments". Examples of such musical instruments include trumpets, horns, French horns, euphoniums, tubas, comets, flugelhorns, tenor horns, baritone horns, sousaphones, and mellophones.

In the present invention, as the invention is applicable to valved wind musical instruments which are formed from polymeric materials, the term "brass" has been omitted. However as will be understood and appreciated by those skilled in the art, the present invention is applicable to musical instruments such as trumpets, horns, French horns, euphoniums, tubas, comets, flugelhorns, tenor horns, baritone horns, sousaphones, and mellophones, although not necessarily formed from a metallic material or alloy such as brass or the like.

Figure 1:
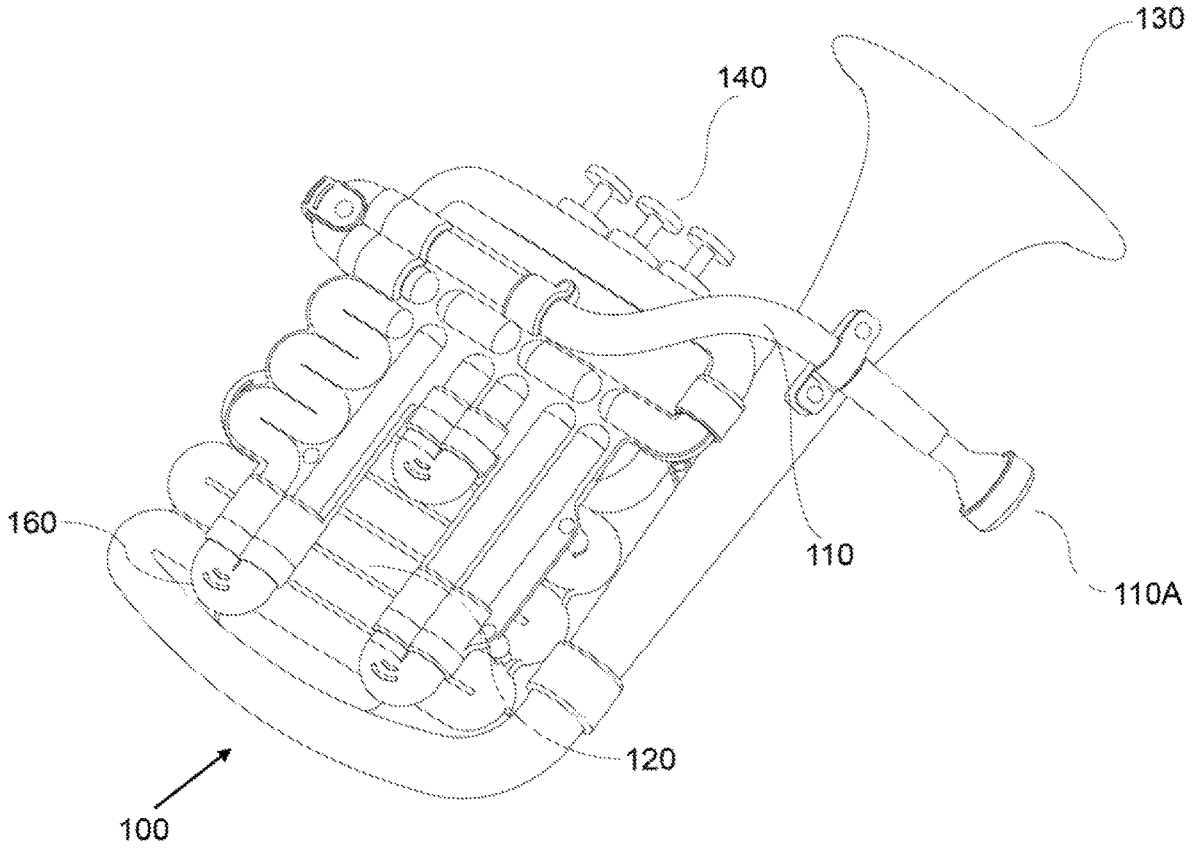
FIG. 1 shows a perspective bottom view of a valved wind instrument in accordance with an embodiment of the present invention.
Figure 2:
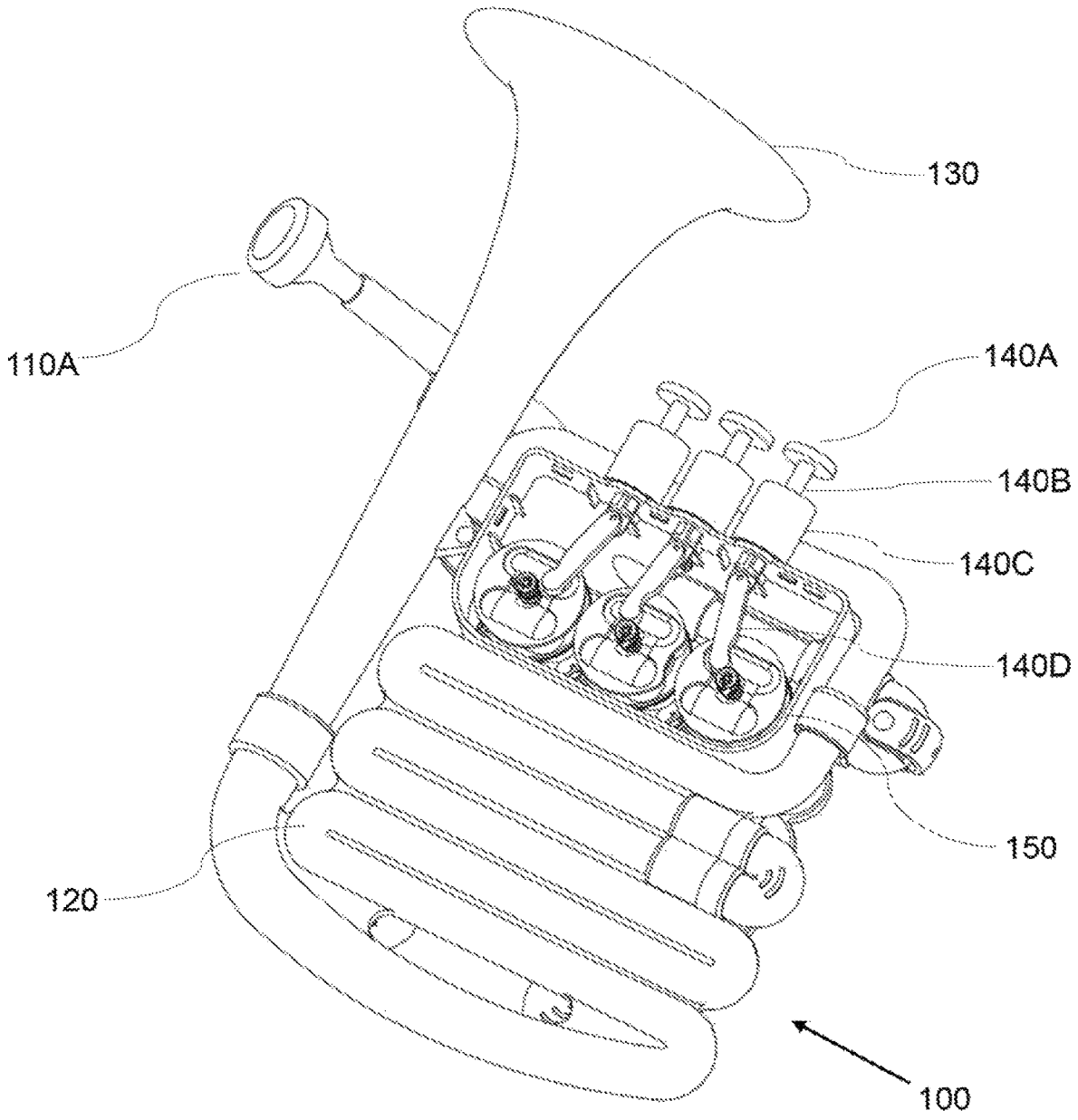
FIG. 2 shows a perspective top view of the valved wind instrument in accordance with the embodiment of the present invention shown in FIG. 1.
Figure 3:
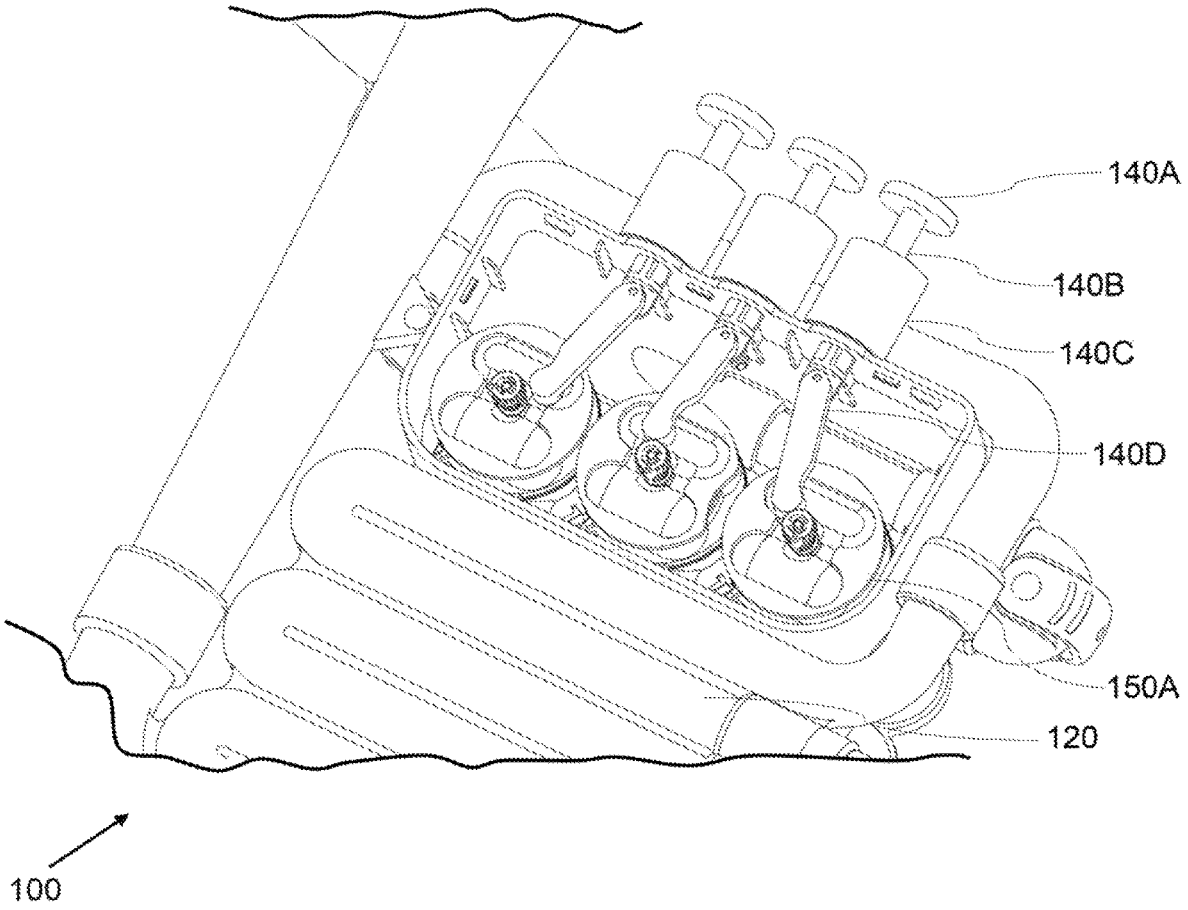
FIG. 3 shows a magnified perspective partial top view of the valved wind instrument in accordance with the embodiment of the present invention shown in FIG. 1.
Figure 4:
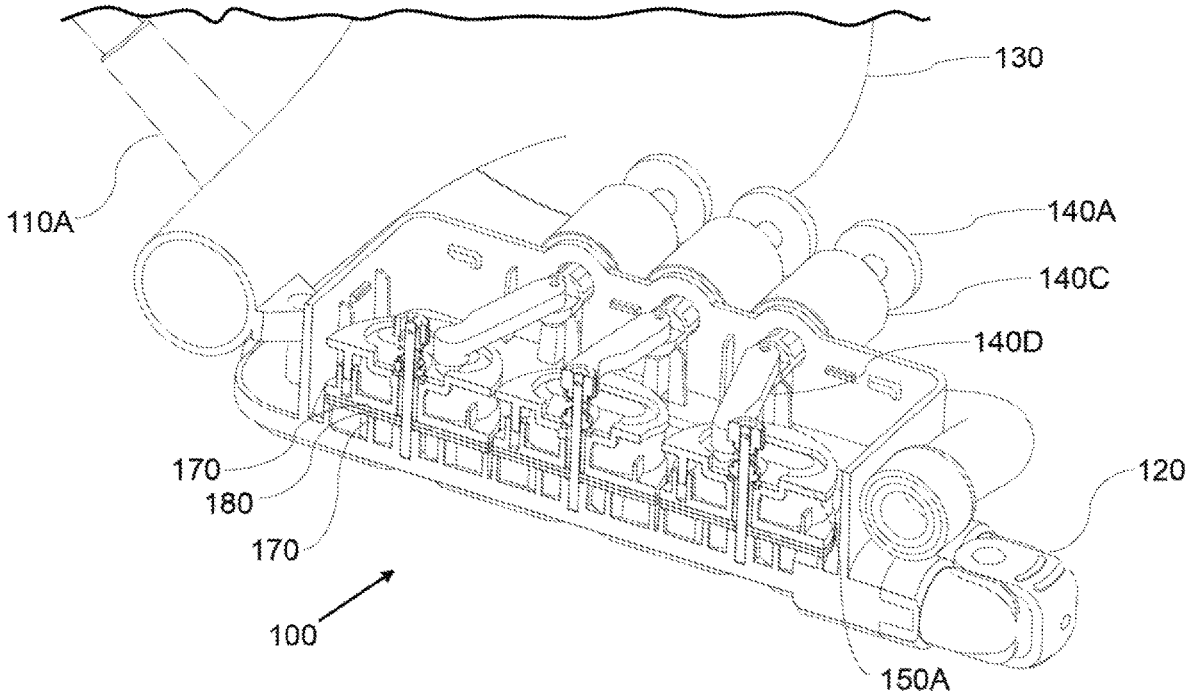
FIG. 4 shows a magnified perspective top cross-sectional view of the valved wind instrument in accordance with the embodiment of the present invention shown in FIG. 1.
Figure 5:
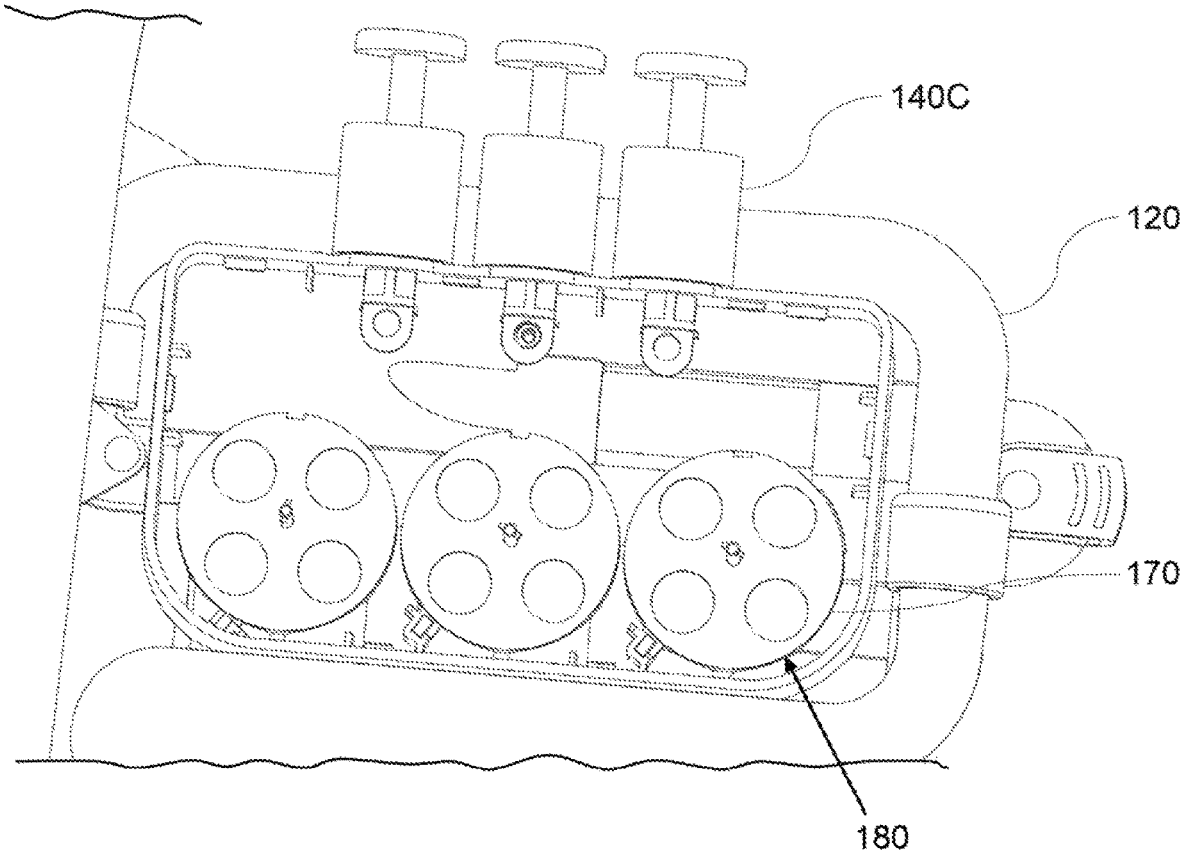
FIG. 5 shows a magnified top partial view of a partially dis-assembled valved wind instrument in accordance with an embodiment of the present invention in which a PTFE planar layer is shown that is configured for positioning between the valve and the tuning body as they rotate relative to each other.
Figure 6:
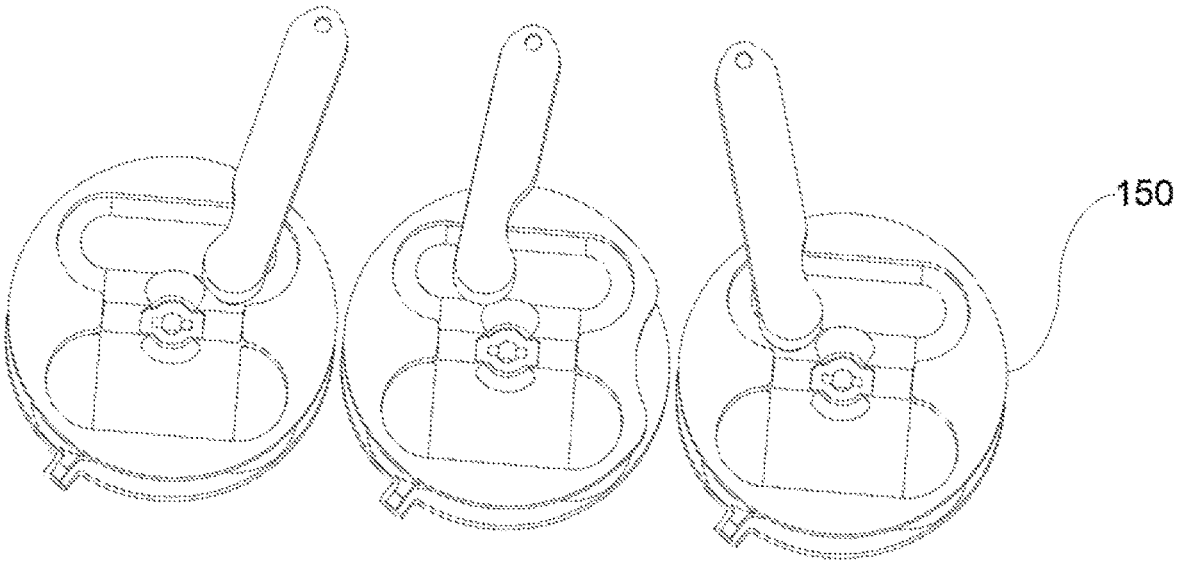
FIG. 6 shows a top view of valves of the valved wind instrument in accordance with the embodiment of the present invention shown in FIG. 5.
Figure 7:
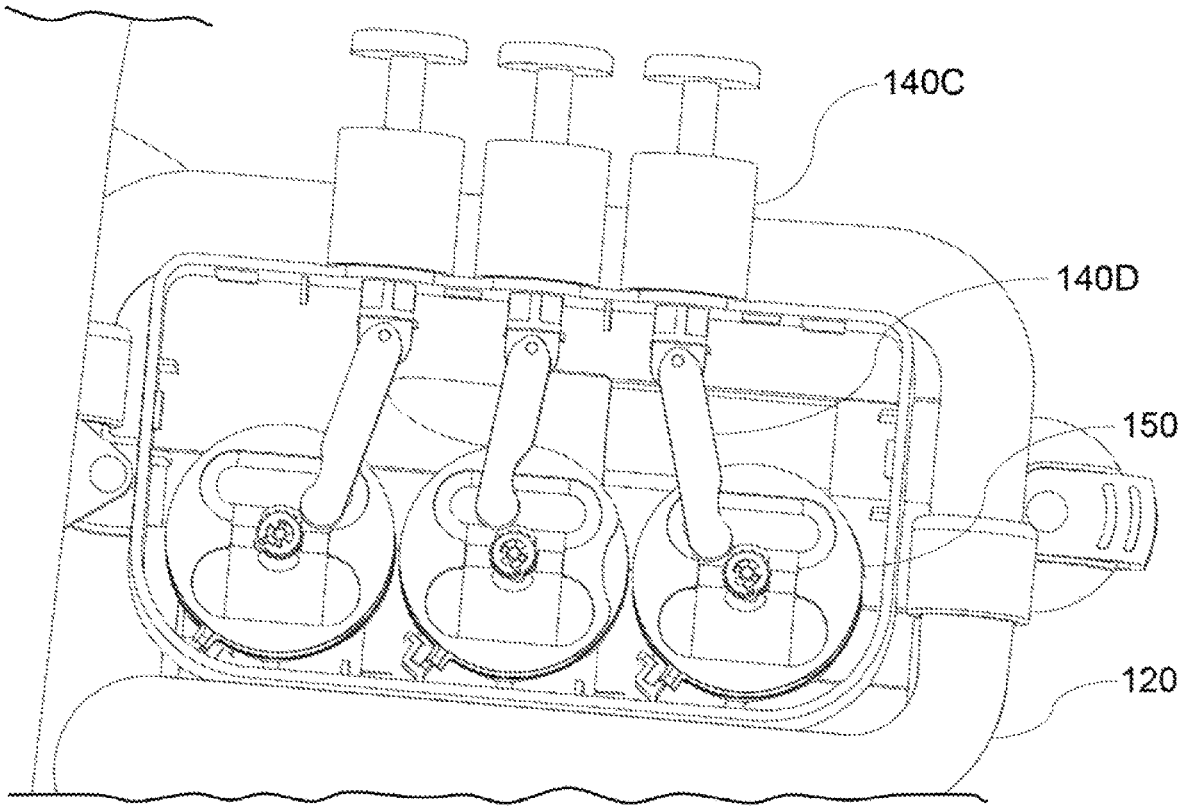
FIG. 7 shows a magnified partial top view of the valved wind instrument in accordance with the embodiment of the present invention in which the cover is removed, and 3 valves are shown operably connected to key members by respective connecting members.

FIGS. 1 and 2 shows a bottom and top perspective view of a valved wind instrument (100) in accordance an embodiment of the present invention. The instrument (100) includes a tubular body having a tuning section (120) with first and second opened ends configured optionally for releasable attachment to a lead pipe (110) and a bell pipe (130) respectively by intermediate screw-threaded adapter rings members or directly by interference fitting. A mouthpiece (110A) is further configured for releasable attachment to the lead pipe (110).

The tuning section (120), lead pipe (110) and a bell pipe (130) may each molded from acrylonitrile butadiene styrene (ABS) or other suitably rigid polymeric material as modular interconnectable pieces that are configured for fitting together to provide a substantially smooth and continuous passage via which a vibrating column of air may pass therethrough during playing of the instrument (100). Each modular piece comprises first and second shell members that are separately molded from ABS or other suitable polymeric material and are bonded together preferably by ultrasonic welding to form the continuous air passage of substantially uniform diameter through each modular piece. In certain embodiments of the present invention, the first and second shell members may be interference fitted together to form an air-tight seal between the respective first and second shell members of each modular piece.

The tubular body is configured to allow a vibrating column of air to pass therethrough. Three valves (150) are each independently operable by a key assembly for movement relative to the tuning section (120) between first configurations and second configurations to selectably vary a length of the tubular body through which the vibrating column of air passes when arranged in the first and second configurations and thereby selectably vary an output pitch of the instrument (100). The valves (150) each include a respective planar surface that are configured to lie flat against a planar surface of the tuning section (120) or to lie flat against an intermediary planar layer as the planar surfaces of the valves (150) are rotated relative to the planar surface of the tuning section (120) between the first and second configurations. Air ingress and air egress openings of air passage ways in the valve are disposed in the planar surfaces of the valves and are configured for alignment with openings to air passage ways disposed in the planar surface of the tuning section in varying configurations as the valves (150) are rotated relative to the tuning section between the first and second configurations.

FIGS. 3 to 7, enlarged views of the valves (150) of the valved wind instrument (100) FIGS. 1 and 2 and further show the instrument (100) including a plurality of key members (140) each being preferably injection molded from an ABS material or other suitable polymeric material or other material. The key members, in the present embodiment, include silicone finger pads (140A) disposed on an end of plungers (140B). The plungers (140B) are configured for reciprocal sliding motion within plunger housings (140C) between first positions in which the plungers (140B) are extended relatively outwardly of the plunger housings (140C) and second positions in which the plungers (140B) are depressed relatively inwardly of the plunger housings (140C). Return springs are positioned in the plunger housings (140C) and configured for biasing the plungers (140B) towards the first positions. Connecting members (140D) are operably-coupled at their first ends to corresponding plungers (140B) and coupled at second ends to rotating members (150A) of the respective valves (150) such that responsive to movement of the plungers (140B) between the first and second positions, the connecting members (140D) are configured to rotate the valves relative to the tuning section (120) between first and second configurations respectively. Whilst in this embodiment the key members (140) comprise depressible buttons for operating the respective valves (150), in other embodiments, the key members may instead comprise levers operably-connected to the valves (150) to effect operation of the valves (150).

The valves (150) are preferably formed from an ABS material and comprise a rotating member (150A) having air passage ways integrally molded therein. Responsive to operation of the key members (140), the rotating members (150A) of the valves (150) rotate relative to the tuning section (120) between the first and second configurations whereby the air ingress and air egress openings of the passage ways within the rotating members (150A) are configured to align with openings in air passage ways of the tuning section (120) in varying configurations. Depending upon how the respective openings are aligned in each of the first and second configurations, air flow is able to be directed through different air-flow passage ways of varying lengths within the tuning section in order for a player to be able to selectably vary the pitch of the instrument (100) as the vibrating column of air passes therethrough. In this embodiment, the air ingress and air egress openings of the passage ways within the rotating members of the valves are configured such that when the rotating members are rotated relative to the tuning section about a 90 degree angle, the openings in the rotating members of the valve are configured to redirect air flow through a different air-flow circuit through the tuning section (i.e. to either lengthen or shorten the overall length of the tuning section) to change the pitch of the instrument.

In this embodiment, the rotating members (150A) each include a planar surface that are configured to lie flat against a planar surface of the tuning section (120) or to lie flat against one or more intermediary planar layers (with air passages ways suitably disposed therein) as the rotating members (150) of the valves (150) are rotated relative to the tuning section (120) between the first and second configurations. The air ingress and air egress openings of the valves (150) and of the tuning section (120) are disposed in the planar surfaces of the valves (150) and the tuning section (120). The air ingress and air egress openings in the respective planar surfaces are configured for rotational movement in to alignment with each other in varying configurations as the rotating members (150A) of the valves (150) are rotated relative to the tuning section (120) between the first configuration and the second configuration so as to selectably vary the length of the tubular body through which the vibrating column of air passes when arranged in the first and second configurations.

In these embodiments a first and a second planar face plate (170) may be conveniently formed by die-cutting the face plates from a material, such as a Polytetrafluoroethylene (PTFE) sheet. The first and second planar face plates (170) may lie directly flat against each of the planar surfaces of the rotating members (150A) of the valves (150) and the planar surface of the tuning section (120). The first and second face plates (170) allow the planar surface of the rotating members (150A) of the valves (150) to rotate more smoothly and freely relative to the planar surface of the tuning section (120), and thereby advantageously allow for a weaker and lighter return spring to be used to bias the key members. Whilst reducing the overall weight of the instrument, this provides the significant advantage of providing greater ease of operation of the key members which is particularly advantageous for small children having weaker finger strength that may be required to play the instrument during a long performance or rehearsal. In certain other embodiments, instead of using a PTFE material as the face plates (170) of the valve (150) and of the tuning section (120), a ceramic material may be used to form the planar face plates (170). A sealing gasket planar layer (180) is disposed between the first and second face plates (170). The sealing gasket planar layer may comprises a closed cell expanded silicone sponge (e.g. which may be termed "bubble wrap") or other elastomeric compound material. This springiness of the sealing gasket (180) urges the first and second face plates (170) against the planar surfaces of the valves and against the planar surface of the tuning section so as to maintain an air-tight seal therebetween.

Figure 8:
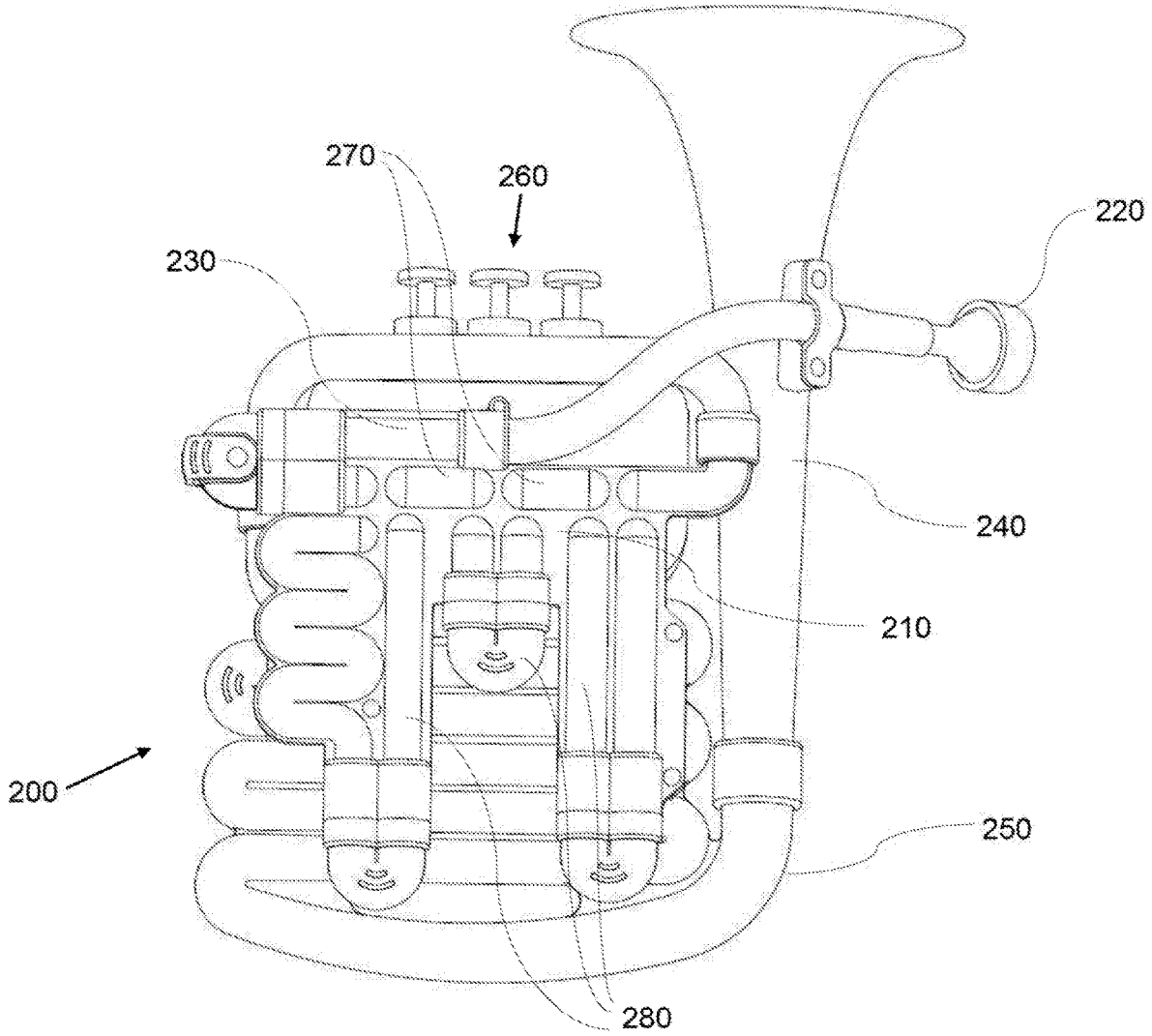
FIG. 8 shows a representation of a planar top view of an embodiment of the present invention.

Referring to FIG. 8, there is shown a top view of a representation of a valved wind instrument (200) according to the present invention. The valved wind instrument (200) of this embodiment includes a rotary valve assembly similar to that as described with reference to the embodiments above, however those skilled in the art should understand that in other or alternate embodiments, other valve arrangements may be implemented, such as piston-type valves as will be known within the art, without departing from the present invention.

The valved wind instrument (200) includes a tubular body having a tuning section (210), a lead pipe (220) connected to a first end (230) of the tuning section (210) and a bell pipe (240) connected to a second end (250) of the tuning section (210).

The tuning section (210) includes an air inlet port at the first end (230) for receiving air flow from the lead pipe (220), an air outlet port for delivering said air flow to the bell pipe (240) at the second end (250), and a plurality of user operable valves (260) which, although not shown explicitly in this drawing, may be understood to be same or similar to those as shown and described in reference to the preceding embodiments.

Each valve of the plurality of valves (260) is in fluid communication with an adjacent valve by a first tubular portion (270) so as to provide fluid communication between the inlet port and the outlet port. Each valve of the plurality of valves (260) is user moveable by a player of the in instrument (200) between a first position and a second position similarly as described in reference to embodiments above, and each so as to increase the air pathway length between the inlet port and the outlet port by way of a second tubular portion (280) which can be called a "crook" within the art.

As can be seen, each of the second tubular portions (280) is coplanar with each other, and the second tubular portions (280) are integrally formed from a polymeric material within the tuning section (210) of the instrument (200), wherein the tuning section (210) is provided by molded first and second body members that are bonded together and sealingly engaged along a plane parallel to the longitudinal axes of the second tubular portions (280).

As such, as the second tubular sections (280) are integrally molded as two halves and then joined, the lengths of the second tubular sections (280) will always be of a constant length between formed instruments, thus providing more consistent tonal intervals than manually assembled tuning assemblies as provided by traditional brass instruments of the prior art, whereby during manufacture as will be known by those skilled in the art the lengths between instruments may vary somewhat, resulting in compensation being required by players to "lip up" or "lip down for flat or sharp intervals or notes. This provides significant advantages in ease of manufacture and assembly, as well as and importantly providing instrument of consistent tuning thus having appropriate tonal intervals by having consistent tuning length of tubing. Further, obviating assembly and manufacturing of the tuning section by traditional processes reduces much manufacturing and assembly time, as well as obviates errors and the need for highly skilled technicians as well as human error or inconsistency.

The two halves which form the tuning section (210) may be joined by processes such as sonic welding, or other suitable processes such as adhesives and the like.

As is shown, in the present embodiment the first tubular portions (270) are coplanar with the second tubular portions (280), and first tubular portions (270) are integrally formed with the second tubular portions (280). This gives further rise to consistency of length of the instrument between different instruments, and provides for greater manufacturing consistency and increased quality, as well as ease of manufacture. Further, such a planar instrument with the tuning section formed as an integral piece, reduces the likelihood of damage or denting of the crooks. As will be known, it is very common for impacts to a brass instrument, even small impacts, to dent the various tubular portions, such as crooks and tuning sections, which in addition to being unsightly, may alter the tone and further may loosen the connection of crooks to a valve body and thus further adversely affect the sound output quality. A compact coplanar arrangement of the present invention, substantially obviates the risk or likelihood of such damage, as well as in addition by the present invention being provided in a polymeric form reduces the likelihood of damage and denting of crooks and tuning slides, as well as lead pipe, bell pipe and bell damage, which can be unsightly in addition to being detrimental to the sound quality. Further, for lacquered brass instruments, dents damage the lacquer and can thus form oxidation initiation sites, these being unsightly as well as potentially compromising the integrity of the instrument.

As will be understood, the tuning section of a valve wind instrument is a critical and main component of the instrument, which determines the frequency and pitch of the tones produced by a player using the instrument. The present invention provides a consistent tuning section which can be assembled in simple single step of joining the two halves. By using a molding and assembly process according to the present invention, with the tuning section of the instrument being integrally formed together at the time of molding, provides significant advantages from commercial, manufacturing and quality of product standpoints. In comparison with traditional metal alloy formed instruments of the prior art, assembly of the tuning section requires skilled and accurate technicians to typically braze tubular portions together, without air leaks and without variation in affirming such that the operational length of the instrument is accurate and correct for the requisite acoustic properties of the instrument. The embodiments of the present invention alleviate such shortfalls of the prior art, as well as significantly reduces production time and the necessity for highly skilled and trained technicians and associated costs during manufacture of the instrument of the present invention.

It will be appreciated that embodiments of the present invention described herein may assist in providing various other advantages over existing brass instruments of the prior art. Firstly, in regard to conventional rotary valves when used in brass instruments, the air ingress and air egress openings of the passage ways formed in the rotating part of the valve are disposed on a curved surface, not a flat surface, and further are formed from metal or a metal alloy. Manufacturing of such conventional rotary valves requires a relatively high degree of precision three-dimensional machining or working of the metal so as to ensure that the openings in the three-dimensional curved surface align precisely with openings in the tuning section of the instrument, so as to effectively re-direct air-flow to change the pitch of the instrument in use by a player, and, to prevent air escaping from between the contact formed by the curved inner surface of the valve housing and the curved outer surface of the valve element, which caused significant loss in sound energy sand quality. In contrast, instruments formed according to embodiments of the present invention have the openings in the valves and openings in the tuning section are configured for movement into alignment with each other in varying configurations within a two-dimensional planar interface, and manufacture and assembly of such instruments does not involve the same degree of complexity, assembly time and cost compared to those of the prior art.

Moreover, as the instruments in embodiments of the present invention may be formed from ABS or other suitable polymeric material, the manufacturing of such instruments may be relatively quick, easy and cost-efficient utilising injection molding and other appropriate manufacturing techniques applicable to such materials and without requiring precision machining of any metal curved surfaces. Furthermore, as the valves may be formed from ABS or other suitable polymeric material, this is much lighter than metal valves and therefore reduces the inertia of the valves during rotation as well as lessening the overall weigh of the instrument. Less restoration force is required by the return spring in order to overcome inertia in the valves in the present invention, as will be understood due to the rotational moving part having a lesser mass than those of the prior art. Furthermore, as the tubular body of the instrument may be injection molded from a polymeric material, it is relatively easy to maintain uniform cross-section within the tubular body, or even alter the diameter if so required in alternative embodiments, using such fabrication techniques compared to conventional manufacturing of metallic brass instruments.

Furthermore, when the tubular body of a conventional brass instrument is damaged, it is relatively expensive to repair and/or replace the damaged body, and requires specialized skill by technicians to effect repair. By injection molding the tubular body from ABS or other suitable polymeric material, the cost of a replacement tubular body would be relatively cheap in comparison to brass instruments of the prior art. Furthermore, as the openings in the valves and openings in the tuning section are configured for movement into alignment with each other in varying configurations within a two-dimensional planar interface, the valve shape and dimensions may be formed in a relatively planar geometry compared to traditional rotary valves, and this relatively planar geometry may fit more compactly within an instrument housing, thus providing an instrument which maybe more suitable for handling by children. Yet further, as the openings in the valve and tuning section are rotatable within a two-dimensional interface, this may assist in ease of manufacturing assembly of such instruments. Yet further, as the instruments formed in accordance with the present invention utilise a rotary type valve, the degree of finger movement required to effect operation of the valves may be minimised.

Those skilled in the art will understand that a valved wind instrument is a musical instrument typically called a "brass instrument", which includes a lead pipe, a tuning section and a bell pipe, whereby sound is generated by the lips of a player vibrating from air expired therebetween into a mouthpiece. Valved brass instruments use a set of valves, typically three or four but as many as seven or more in some cases, which are operated by the player's fingers that introduce additional tubing, or crooks, into the instrument, changing its overall length so as to allow production of different pitched tones Such instruments are also called also called labrosones, literally meaning "lip-vibrated instruments".

Examples of such musical instruments include trumpets, horns, French horns, euphoniums, tubas, cornets, flugelhorns, tenor horns, baritone horns, sousaphones, and mellophones.

In the present invention, the term "brass" has been omitted, and the material from which the valved instruments of the present invention is formed is not a metal, but rather a polymeric material and as such, said omission removed ambiguity or misunderstanding. In any event, the term "valved wind instrument" as utilized in the present invention is used to denote a musical instrument historically termed as a "brass instrument", and the present invention is applicable for implementation in the manufacture of such instruments also including musical instruments such as trumpets, horns, French horns, euphoniums, tubas, comets, flugelhorns, tenor horns, baritone horns, sousaphones, and mellophones.

Those skilled in the art will appreciate that the invention described herein is susceptible to variations and modifications other than those specifically described without departing from the scope of the invention. All such variations and modification which become apparent to persons skilled in the art, should be considered to fall within the spirit and scope of the invention as broadly hereinbefore described. It is to be understood that the invention includes all such variations and modifications. The invention also includes all of the steps and features, referred or indicated in the specification, individually or collectively, and any and all combinations of any two or more of said steps or features.

The reference to any prior art in this specification is not, and should not be taken as, an acknowledgment or any form of suggestion that that prior art forms part of the common general knowledge.

What is claimed is:

1. A valved wind instrument including:

a tubular body having a tuning section, a lead pipe connected to a first end of the tuning section and a bell pipe connected to a second end of the tuning section, said tubular body being configured to allow a vibrating column of air to pass therethrough;

a valve operable by a key assembly for movement relative to the tuning section between at least one of a first configuration and a second configuration to selectably vary a length of the tubular body through which the vibrating column of air passes when arranged in the first and second configurations and thereby selectably vary an output pitch of the valved wind instrument;

wherein the valve and the tuning section each include a respective planar surface that are configured to lie flat against each other or flat against an intermediary planar layer as the valve is moved relative to the tuning section between the first configuration and the second configuration and whereby air ingress and air egress openings are disposed in the planar surfaces of the valve and the tuning section, said air ingress and air egress openings in the respective planar surfaces being configured for movement in to alignment with each other in varying configurations as the valve is moved relative to the tuning section between the first configuration and the second configuration so as to selectably vary the length of the tubular body through which the vibrating column of air passes when arranged in the first and second configurations.

2. A valved wind instrument as claimed in claim 1 wherein the tubular body is formed from a polymeric material.

3. A valved wind instrument as claimed in claim 1 wherein the tubular body includes separately molded first and second tubular body members that are bonded together, and wherein the first and second tubular body members are bonded together by ultrasonic welding.

4. A valved wind instrument as claimed in claim 1 wherein the planar surfaces of the valve and the tuning section are configured for at least one of rotational and slidable movement relative to each other as the valve is moved relative to the tuning section between the first configuration and the second configuration so as to selectably vary the length of the tubular body through which the vibrating column of air passes.

5. A valved wind instrument as claimed in claim 1 wherein at least three intermediate planar layers are disposed between the planar surfaces of the valve and of the tuning section, said three intermediate planar layers including a first and second intermediate planar layers formed from a PTFE material disposed adjacent the planar surfaces of the valve and tuning section, and a third intermediate planar layer disposed between the first and second intermediate planar layers, said third intermediate planar layer including the sealing gasket layer formed from an elastomeric material.

6. A valved wind instrument as claimed in claim 1 wherein the key assembly includes:

a finger-operable key member that is movable between at least one of a first position and a second position, said key member being biased into the first position by a biasing member;

a connecting member operably-coupled at a first end to the key member and at a second end to the valve such that responsive to movement of the key member from the first position in to the second position, the connecting member is configured to move the valve relative to the tuning section between the first and second configurations respectively.

7. A valved wind instrument as claimed in claim 1 wherein the key assembly is formed from a polymeric material.

8. A valved wind instrument as claimed in claim 1 wherein the key member of the key assembly includes at least one of a depressible button and a lever.

9. A valve for use with a valve wind instrument having a tubular body configured having a tuning section, a lead pipe connected to a first end of the tuning section and a bell pipe connected to a second end of the tuning section, said tubular body being configured to allow a vibrating column of air to pass therethrough;

said valve being operable for movement relative to the tuning section between at least one of a first configuration and a second configuration to selectably vary a length of the tubular body through which the vibrating column of air passes when arranged in the first and second configurations and thereby selectably vary an output pitch of the valved wind instrument;

wherein the valve and the tuning section each include a respective planar surface that are configured to lie flat against each other or flat against an intermediary planar layer as the valve is moved relative to the tuning section between the first configuration and the second configuration and whereby air ingress and air egress openings are disposed in the planar surfaces of the valve and the tuning section, said air ingress and air egress openings in the respective planar surfaces being configured for movement in to alignment with each other in varying configurations as the valve is moved relative to the tuning section between the first configuration and the second configuration so as to selectably vary the length of the tubular body through which the vibrating column of air passes when arranged in the first and second configurations.

10. A valve as claimed in claim 9 wherein the tubular body of the valved wind instrument is formed from a polymeric material.

11. A valve as claimed in claim 9 wherein the tubular body of the valved wind instrument includes separately molded first and second tubular body members that are bonded together, and wherein the first and second tubular body members of the valved wind instrument are bonded together by ultrasonic welding.

12. A valve as claimed in claim 9 wherein the planar surfaces of the valve and the tuning section of the valved wind instrument are configured for at least one of rotational and slidable movement relative to each other as the valve is moved relative to the tuning section between the first configuration and the second configuration so as to selectably vary the length of the tubular body through which the vibrating column of air passes.

13. A valve as claimed in claim 9 wherein at least three intermediate planar layers are disposed between the planar surfaces of the valve and of the tuning section of the valved wind instrument, said three intermediate planar layers including a first and second intermediate planar layers formed from a PTFE material disposed adjacent the planar surfaces of the valve and tuning section of the valved wind instrument, and a third intermediate planar layer disposed between the first and second intermediate planar layers, said third intermediate planar layer including the sealing gasket layer formed from a elastomeric material.

14. A valve as claimed in claim 9 wherein the key assembly includes:

a finger-operable key member that is movable between at least one of a first position and a second position, said key member being biased into the first position by a biasing member;

a connecting member operably-coupled at a first end to the key member and at a second end to the valve such that responsive to movement of the key member from the first position in to the second position, the connecting member is configured to move the valve relative to the tuning section between the first and second configurations respectively.

15. A valve as claimed in claim 14 wherein the key is formed from a polymeric material.

16. A valve as claimed in claim 14 wherein the key member of the key assembly includes at least one of a depressible button and a lever.

* * * * *